US005735205A

United States Patent [19]

Nordgren

[11] Patent Number: 5,735,205

[45] Date of Patent: Apr. 7, 1998

[54] PRINTING PRESS CONTROLLER

[75] Inventor: Richard Eric Nordgren, Daleville, Va.

[73] Assignee: Westvaco Corporation, New York, N.Y.

[21] Appl. No.: 744,607

[22] Filed: Nov. 7, 1996

[51] Int. Cl.[6] ..... B41F 13/24

[52] U.S. Cl. ..... 101/181; 101/248

[58] Field of Search ..... 101/181, 183, 101/248; 318/39, 49, 77, 85, 111

[56] References Cited

U.S. PATENT DOCUMENTS

| | | | |
|---|---|---|---|
| 3,915,090 | 10/1975 | Horst et al. | 101/181 |
| 4,724,763 | 2/1988 | Bolza-Schunemann et al. | 101/181 |
| 4,852,785 | 8/1989 | Bettendorf et al. | 101/181 |
| 4,887,530 | 12/1989 | Sainio | 101/181 |
| 4,906,908 | 3/1990 | Papiernik et al. | 318/85 |
| 5,076,163 | 12/1991 | Sainio | 101/181 |
| 5,209,161 | 5/1993 | Derivi et al. | 101/486 |
| 5,263,413 | 11/1993 | Ikeguchi | 101/183 |
| 5,313,886 | 5/1994 | Müller | 101/486 |
| 5,327,826 | 7/1994 | Rodi | 101/181 |
| 5,365,847 | 11/1994 | Pers | 101/248 |
| 5,483,893 | 1/1996 | Isaac et al. | 101/485 |
| 5,500,801 | 3/1996 | Löffler | 101/486 |

*Primary Examiner*—John S. Hilten
*Assistant Examiner*—Steven S. Kelley
*Attorney, Agent, or Firm*—J. R. McDaniel; R. L. Schmalz

[57] ABSTRACT

This invention relates to controllers for printing presses. Such structures of this type, generally, utilize information gathered at earlier production stages, such as, the crease register to improve the through put of later stages, such as, printing.

6 Claims, 1 Drawing Sheet

PRINTING PRESS CONTROLLER

BACKGROUND OF THE INVENTION

1. Field of the Invention

This invention relates to controllers for printing presses. Such structures of this type, generally, utilize information gathered at earlier production stages, such as, the crease register to improve the throughput of later production stages, such as, printing.

2. Description of the Related Art

Typically, in web fed processing facilities, individual pieces of equipment sequentially operate on the web material to create a finished product. For example, a reel of unprinted bleached board may be creased on a first production machine and then printed on a subsequent web-fed, offset printing press. Any manufacturing errors created during the initial steps of manufacturing often have a deleterious effect on the quality and speed of production on those later operations.

The present invention represents a modification to a standard continuous web fed printing press with a means of automatic register control. Such a printing press utilizes pre-printed register marks on the web such that the desired graphical image is applied at a pre-determined distance from these marks. Such printing presses are commonly used in carton forming where the pre-printed register marks signal the presence and location of mechanical impressions, such as, creases on the web. Typically, the press register controller regulates the infeed web tension by means of a set of nipped rolls such that the printed images are applied at a desired position in relation to these pre-printed register marks. Within the controller, a timing error signal is typically formed by comparing the register mark photo-sensor signal and the impression cylinder 0° position signal. Using this error signal, the controller adjusts the web tensioner to make this error zero.

It is also known to employ a device that is capable of correcting for mis-register between an embossed pattern and a printed pattern. Exemplary of such prior out is U.S. Pat. No. 3,915,090 ('090), to R. L. Horst, entitled "Printed Pattern and Embossed Pattern Registration Control System". While the '090 reference corrects for mis-register in a mechanical impression on the web, it is not capable of anticipating required changes in infeed web tension necessary to minimize the effects of earlier manufacturing defects. Out of specification material is invariably created whenever significant changes in infeed web tension are required to maintain proper print registration, when using conventional register control. Therefore, a more advantageous system would be presented if the system was capable of controlling register on successive web fed devices whereby the web has been initially processed and then subsequently processed, and is capable of utilizing information collected at the initial manufacturing stage to improve performance at later stages.

It is apparent from the above that there exists a need in the art for a printing press controller which is able to control the printer and which is capable of controlling the register on successive web fed devices whereby the web has been initially processed and then subsequently processed, but which is capable of utilizing information collected at the initial manufacturing stages to improve performance at later stages.

It is the purpose of this invention to fill this and other needs in the art in a manner more apparent to a skilled artist once given the following disclosure.

SUMMARY OF THE INVENTION

Generally speaking, this invention fulfills these needs by providing a printing press controller, comprising a first printing press production stage data input means, a first filter means operatively connected to the first production stage data input means, a model means operatively connected to the first filter means, a signal feedback means operatively connected to the model means, a data set-point entry means operatively connected to the signal feedback means, and a second printing press production stage data input means operatively connected to the signal feedback means.

In certain preferred embodiments the first filter means is a low pass filter. Also, the signal feedback means includes a first controller means and converter means.

In other preferred embodiments, the printing press controller takes advantage of the information generated at an earlier production stage, such as, at the creaser/laminator. The control system adjusts the web tension of the printing press using register length information. This type of control system may readily be implemented on any conventional PC-type computer hardware having an appropriate interface hardware.

The preferred controller, according to this invention, offers the following advantages: lightness in weight; ease of assembly and repair; improved printing press controller characteristics; increased printing press production; decreased printing error; increased stability; good durability; and increased economy. In fact, in many of the preferred embodiments, these factors of ease of assembly, improved controller characteristics, increased production, and decreased printing errors are optimized to the extent as considerably higher than heretofore achieved in prior, known printing press controllers.

BRIEF DESCRIPTION OF THE DRAWING

The above and other features of the present invention, which will become more apparent as the description proceeds, are best understood by considering the following detailed description in conjunction with the accompanying drawing, in which the single FIGURE is a schematic illustration of a printing press controller, according to the present invention.

DETAILED DESCRIPTION OF THE INVENTION

Figure 1:
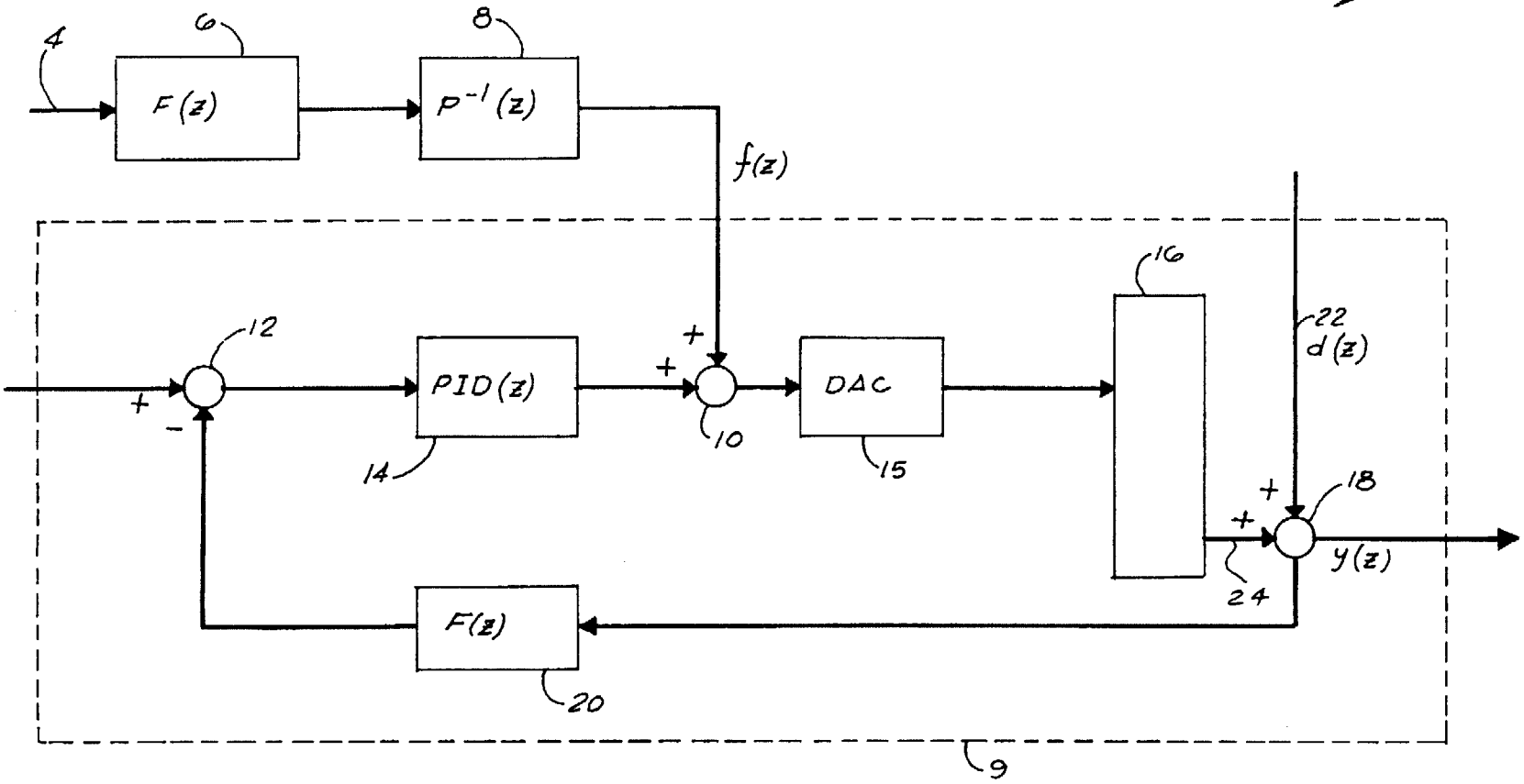

With reference to the single FIGURE, there is illustrated a controller 2 for conventional printing press 16. Controller 2 includes, in part, printing press production stage data input 4, conventional filter 6, conventional inverse plant model 8 and signal feedback loop 9. Signal feedback loop 9 includes, in part, conventional summers 10, 12, and 18, conventional PID controller 14, digital-to-analog converter 15, conventional printing press 16, conventional filter 20, disturbance signal input 22 and register length measurement 24.

In particular, filters 6 and 20, preferably, are low-pass filters. Also, model 8 may be commonly referred to as a forward path controller. Finally, converter 15 is also referred to as a zero-order hold.

It is to be understood that the configuration of controller 2 will be illustrated and described using a creasing/laminating machine (not shown) as the initial processing section followed by a conventional printing press 16.

During the operation of the first processing station, such as, a creasing/laminating machine (not shown) information concerning the reel rewind creased register, web tension and web speed from the creasing/laminating machine, are recorded by conventional techniques using a digital computer. Typically, this information is collected using conventional data acquisition equipment with a conventional interrupt driven software program system. This information is forwarded to controller 2 as printing press production stage data input signal 4. The data collected on the creasing/laminating machine is used to generate the predictive signal (signal 4), which is first filtered by filter 6 before passing through inverse plant model 8. The signal from model 8 is then forwarded to summer 10. During the operating of printing press 16, information (input 22) concerning web tension and web speed in printing press 16 is collected by conventional techniques and forwarded to controller 2 as disturbance signal input 22. This information represents any register length non-uniformities that are the result of any manufacturing defects in the unprinted roll or tension disturbances that occur during the printing process as a result of mechanical imperfections.

The flow of the feedback loop 9 begins at data summer 12 which can also be referred to as data set-point entry 12. This is the desired operating value that is entered by the operator into the computer (not shown) which is running printing press controller 2. This set-point is sent to feedback loop 9 which adjusts web tension at the unwind end (not shown) of printing press 16 using register length measurement 24 from a rotary position encoder (not shown) on printing press 16 and controller 14 to calculate a web tension command signal which is produced from the output of digital-to-analog converter 15 and forwarded to printing press 16.

As shown in the FIGURE, web fed printing press 16 and register control controller 14 are illustrated. Summer 12 represents the image offset target (usually zero) for the impression roll 0° position the pre-printed register mark position and the pre-printed register mark. The pre-printed register mark being previously discussed. Input 22, as discussed previously, represents any register length non-uniformities that are the result of any manufacturing defects in the unprinted roll or tension disturbances that occur during the printing process as a result of mechanical imperfections.

As a further discussion, the subject of this disclosure pertains to a device capable of producing an input signal f(z) and applying it to the summing junction 10 within the controller 2. This signal may be generated by personal computer type hardware that has access to archival process (register length) information that has been stored during the manufacture (e.g. the mechanical impression process) of the unprinted roll. Input register length data 4 collected during manufacture is first processed using digital filter 6, which has no restriction on the number of its 'forward terms'. This processed signal is applied to filter 6 which makes use of a printing press tension-to-register model 8 to create an offsetting signal f(z) thereby reducing the impact of the disturbance input 22 on the resulting register error.

The disturbance 22, as discussed above, should be the sum of all the disturbance signals from the prior creasing/laminating machine step and can be referred to as d/z). The signal from summer 18 to filter 20 is created by the tension adjustment on printing press 16.

In order to eliminate register errors caused by disturbances in the earlier processing stages of the creasing/laminating machine, the printing press controller 2 is utilized. If the actual register from printing press 16 is denoted as y(z), it may be thought of as being compared to the cumulative effects of disturbances from the earlier processing stages in the creasing/laminating machine and the efficacy of the predictive portion of the control scheme as illustrated in Equation 1 below:

$$y(z)=S(z)d(z)+U(z)f(z) \quad \text{(Equation 1)}$$

where the predictive signal is denoted by f(z) and the effect of the output from the disturbance and the predictive signal are characterized by S(z)and U(z), respectfully. The signal f(z) should then be generated as shown below in Equation 2:

$$f(z)=-(S/U)(z)d(z) \quad \text{(Equation 2)}$$

which may be done using an inexpensive PC-type hardware.

In short, information from the previous manufacturing stage is collected and forwarded to data input 4. Information from the current manufacturing stage is collected and forwarded to signal input 22. The information from the previous and present manufacturing stages is manipulated by controller 2 and compared with the data set-point entry in order to adjust a printing press 16 so that the predetermined desired operating parameter of printing press 16 are achieved. Namely, y (z) equals approximately zero.

Once given the above disclosure, many other features, modifications or improvements will become apparent to the skilled artisan. Such features, modifications or improvements are, therefore, considered to be a part of this invention, the scope of which is to be determined by the following claims.

What is claimed is:

1. A printing press controller for controlling printing press register non-uniformities, wherein said controller is comprised of:

a first printing press production stage data input means;

a first filter means operatively connected to said first printing press production stage data input means;

a model means operatively connected to said first filter means;

a signal feedback means operatively connected to said model means;

a data set-point entry means operatively connected to said signal feedback means; and a second printing press production stage data input means operatively connected to said signal feedback means wherein said signal feedback means is further comprised of;

a PID controller means operatively connected to said data set-point entry means, a first summer means operatively connected to said model means and said PID controller means, a converter means operatively connected to said first summing means, a printing press means operatively connected to said converter means, a second summer means operatively connected to said printing press means and said second printing press production stage data input means, and a second filter means operatively connected to said second summer means and said data set-point entry means.

2. The controller, as in claim 1, wherein said model means is further comprised of:

an inverse plant model.

3. A method for controlling printing press register non-uniformities, wherein said method is comprised of the steps of:

determining a desired printing press register value of a printing press;

collecting a production register value;

filtering said production register value;

forwarding said filtered production register value to a model means;

forwarding said production register value from said model means to a signal feedback means;

collecting a first printing press register value;

forwarding said first printing press register value to said signal feedback means;

determining an actual printing press register value in said signal feedback means;

comparing said actual printing press register value with said desired printing press register value; and adjusting, if necessary, said printing press.

4. The method, as in claim 3, wherein said step of filtering said production register value is further comprised of the step of:

low-pass filtering said production register value.

5. The method, as in claim 3, wherein said step of determining said actual printing press register value is further comprised of the steps of:

forwarding said desired printing press register value to a first summing means to create a first summed value;

forwarding said first summed value to a PID controller means;

forwarding a signal from said PID controller means to a second summing means located substantially within said signal feedback means;

forwarding said production register value from said model means to said second summing means;

forwarding a signal from said second summing means to a converter means;

forwarding a signal from said converter means to said printing press;

forwarding a signal from said printing press to a third summing means located substantially within said signal feedback means;

forwarding said first printing press register value to said third summing means;

filtering a signal from said third summing means; and forwarding said filtered signal from said third summing means to said first summing means.

6. The method, as in claim 5, wherein said step of determining said actual printing press register value is determined according to the Equation $$y(z)=S(z)d(z)+U(z)f(z),$$

where y(z)=the actual printing press register value, S(z) d(z)= the first printing press register value, and U(z) f(z)= the filtered production register value.

* * * * *